US005839501A

United States Patent [19]

Delassus et al.

[11] Patent Number: 5,839,501

[45] Date of Patent: Nov. 24, 1998

[54] CASTING ROLL FOR A PLANT FOR CONTINUOUS CASTING ONTO ONE OR BETWEEN TWO ROLLS

[75] Inventors: Pierre Delassus, Locon; François Mazodier, Saint-Etienne; Jean-Marie Pelletier, Bethune; Gérard Raisson, Nevers, all of France

[73] Assignees: Unicor-Sacilor, France; Thyssen Stahl Aktiengesellschaft, Germany

[21] Appl. No.: 803,313

[22] Filed: Feb. 20, 1997

[30] Foreign Application Priority Data

Feb. 29, 1996 [FR] France ..... 96 02652

[51] Int. Cl.[6] ..... B22D 11/06

[52] U.S. Cl. ..... 164/428; 164/429; 492/45; 492/46; 492/47

[58] Field of Search ..... 164/428, 429, 164/479, 480, 442, 448; 492/45, 46, 47

[56] References Cited

U.S. PATENT DOCUMENTS 4,299,018 11/1981 Bickerstaff et al. ..... 492/45

4,944,342 7/1990 Lavener ..... 164/428 X

FOREIGN PATENT DOCUMENTS 0428464 5/1991 European Pat. Off. .

0499562 8/1992 European Pat. Off. .

0650789 5/1995 European Pat. Off. .

4041957 6/1992 Germany .

*Primary Examiner*—J. Reed Batten, Jr.

*Attorney, Agent, or Firm*—Nilles & Nilles, S.C.

[57] ABSTRACT

The casting roll includes a hub (2) and a shell (3) which are arranged coaxially, and two flanges (5, 6) for supporting and radially centering the shell on the hub. Each flange includes a frustoconical part (51, 61) which cooperates with a corresponding frustoconical surface (34, 35) of the bore in the shell, the frustoconical surface being located in a region (A) where the internal diameter variations of the shell due to the expansion deformations are substantially zero.

11 Claims, 2 Drawing Sheets

CASTING ROLL FOR A PLANT FOR CONTINUOUS CASTING ONTO ONE OR BETWEEN TWO ROLLS

Figure 1:
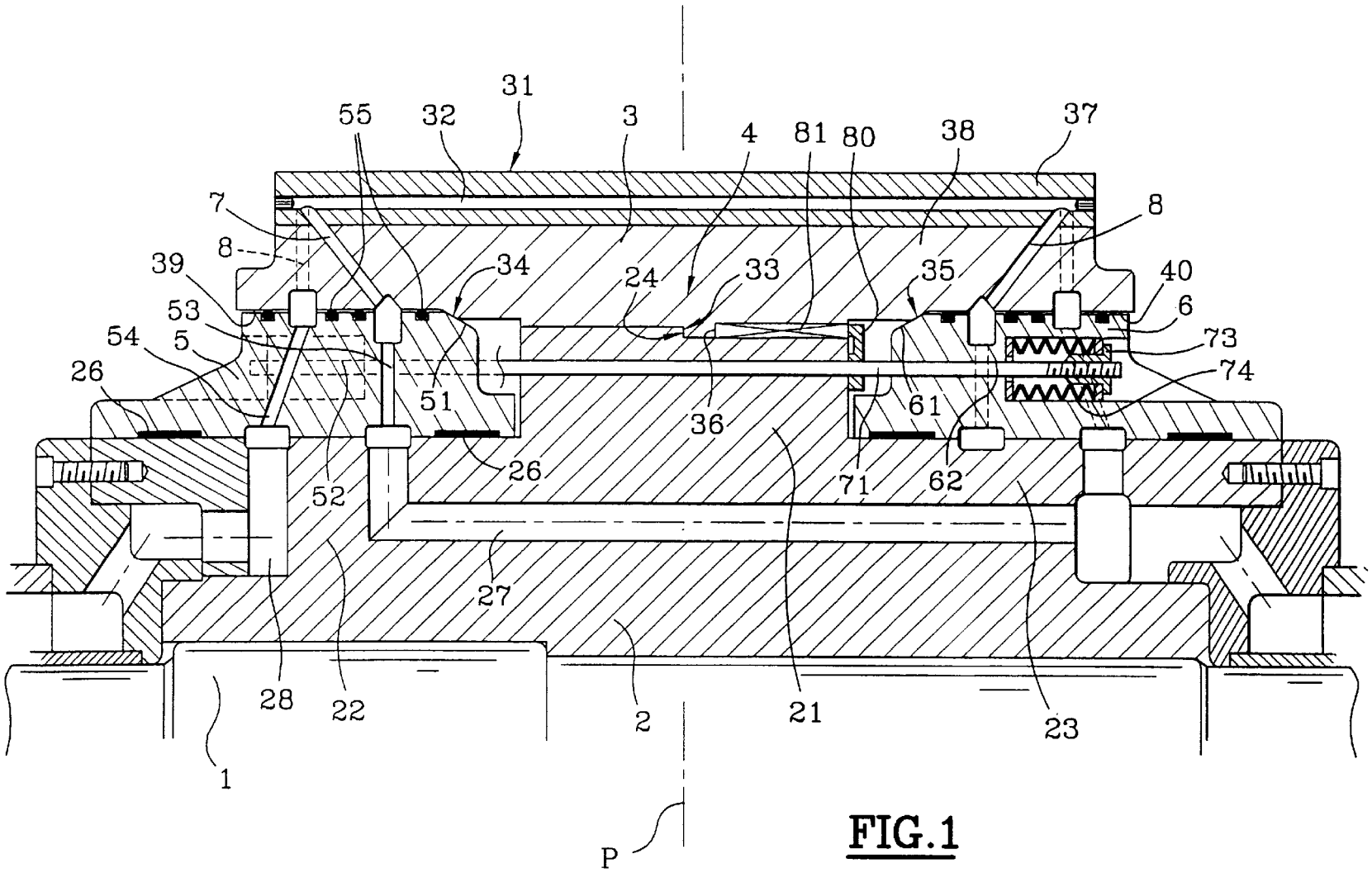

The invention relates to the continuous casting of metals, in particular steel, onto one or between two rolls, and more particularly to the structure of a roll of a plant for continuous casting according to the aforementioned technique.

It is known that a particular casting technique, commonly referred to as twin-roll continuous casting, has been developed with the aim of obtaining metal products of small thickness, for example thin strips with a thickness of a few millimetres, in particular made of steel, directly by casting molten metal. This technique consists in pouring molten metal into a casting space formed between two cooled rolls having parallel axes and two side closure walls, known as side dams, generally arranged against the front end surfaces of the rolls. The metal solidifies in contact with the walls of the rolls and, by rotating these rolls in opposite directions, an at least partially soldified metal strip is extracted, the thickness of which is substantially equal to the distance separating the two rolls. This technique makes it possible to obtain thin metal strips, in particular made of steel, directly from the molten metal.

The small thickness of these strips allows them then to be rolled directly by cold rolling.

There is also another known casting technique, intended for obtaining even thinner products, according to which the liquid metal, poured onto the surface of a single rotating roll, solidifies entirely in contact with the roll to form a continuous metal strip.

The rolls used for implementing these casting techniques are generally internally cooled and include a hub and a shell which are arranged coaxially, means for linking the shell to the hub axially and in rotation, and means for supporting and centring the shell on the hub.

Rolls of this type are, for example, described in document FR-A-2,711,561. This document describes a roll which includes a hub supporting a shell made of a material with high thermal conductivity, for example a copper alloy. The shell includes circulation channels for a coolant, which are oriented parallel to the axis of the roll.

The shell is axially positioned on the hub by a hub shoulder located level with the axially central plane of the roll, on which a corresponding shoulder, formed on the internal surface of the shell, is kept in abutment. The shell is centered by flanges whose external surface is conical and cooperates with conical bores formed on the edges of the shell. The two flanges can slide axially on the hub, and they are returned towards each other by elastic return means. Centering of the shell is thus ensured and maintained when the shell deforms under the effect of the expansions due to the heating during casting. Furthermore, as illustrated by FIGS. 4 and 5 of the aforementioned document, the exterior regions of the outer edges of the conical bores in the shell have a relief so as to be applied progressively onto the conical surface of the flanges when the edges of the shell deform under the effect of the differential expansion of the external surface of the shell relative to its colder internal surface, this being without the regions of the conical surfaces, initially in contact, of the flanges and of the shell respectively, moving apart from one another.

This arrangement has benefit only when the edges of the shell are of small thickness, and when it is therefore necessary to ensure the largest possible contact area level with the conical bearing region between the flange and shell.

The object of the present invention is to provide a novel embodiment of the centering of the shell on the hub of a casting roll, which is particularly well-suited when, in contrast to the aforementioned technique, the shell has a relatively large thickness on the edges. It will be noted that a thick-edged shell of this type has the advantage of being less susceptible to deformations, in particular localized deformations. Furthermore, a thin-edged shell, centered and supported only by the conical end bearing regions, necessarily has an axially central part which is much thicker than its edges. In contrast to this, a thick shell may keep an approximately constant thickness over its entire length; the shape of its cross-section through a radial plane is overall continuous over its entire length, that is to say that it has only small thickness variations from one edge to the other, and therefore the inevitable deformations which it undergoes during casting remain uniform over its entire length.

Another advantage of the use of thick shells is that, through their thickness, they may consist of several layers of different materials. For example, the material of the outer layer, in contact with the metal which is cast, may be particularly suited for ensuring rapid solidification of the metal which is cast on its contact, and the material of the inner layer being more suited to ensure that the overall shell is mechanically strong.

The object of the invention is therefore to ensure that a shell of this type and the hub are concentric both when hot and when cold, and, in spite of the inevitable deformations due to expansions, to obtain a high-quality metal strip of a perfect uniformity in terms of thickness and longitudinal profile. A further object is to facilitate the manufacture of the shell and to ensure better sealing of the coolant circuits at the interface between the flanges and the shell.

With these objects in mind, the subject of the invention is a casting roll for a plant for continuous casting of metals onto one roll or between two such rolls, this roll including a hub and a shell which are arranged coaxially, and two flanges for supporting and radially centering the shell on the hub, characterized in that each flange includes a frustoconical part which cooperates with a corresponding frustoconical surface of the bore in the shell, the said frustoconical surface being located in a region where the internal diameter variations of the shell, due to the thermal expansion deformations, are substantially zero.

The radial centering of the shell on the flanges is therefore ensured by these frustoconical bearing regions. Since the latter are located in a region where the internal diameter variations of the shell due to the expansion deformations are substantially zero, the centering is therefore always ensured by the same shell/flange contact regions, which remain approximately fixed in position, even when the shell is thermally deformed, and which define positional references for the shell which are the same when cold and when hot. Furthermore, since the centring of the flanges on the hub is otherwise ensured, and cannot be interfered with by thermal deformations since it takes place in a region of the cylinder where the temperature is essentially constant, this results in the concentricity of the shell relative to the shaft of the roll being ensured permanently, regardless of the temperature variations of the shell.

The axial position of the points where the internal diameter variations of the shell, due to the expansion deformations of this shell, are substantially zero can be determined using computation models or experimentally. It is in fact thus possible to determine the deformation of the shell as a function of the constructional and working parameters of the roll. This deformation of the shell is illustrated, intentionally exaggerated, in FIG. 3 of the appended drawings. This figure schematically and partially represents the shell 3 in section through a radial plane of the roll. The dot and dash line represents the shape of the shell when cold, reference 31' denoting the external surface of the shell, and reference 31" denoting its internal surface, the generatrix of which has, for the sake of simplifying the drawing, here been represented by a simple straight line. The solid line represents the shell when hot, deformed under the effect of the thermal expansions. It will be noted that a first effect of the heating of the shell is a radial expansion, leading to an increase in the diameter of the shell which is illustrated by the arrow $F_1$. If the temperature of the shell, when hot, were uniform, this radial expansion would be virtually the only observable effect, with a purely axial expansion. In practice, however, during casting the outer surface layer of the shell is heated much more strongly, in contact with the metal which is cast, than the interior of the shell, which remains at low temperature because of the intense internal cooling to which it is subjected. This results in a differential expansion which causes an extension, in the axial direction, of the outer layer of the shell, which is greater than that of the inner layer. This differential expansion therefore leads to a flexural deformation of the shell, illustrated by the arrow $F_2$ in FIG. 3, which tends to bring the edge of the shell towards the axis of the roll. For equivalent heat-exchange conditions, this deformation is commensurately less with increasing thickness of the shell under the cooling channels, since this thick cold part prevents the deformation of the region located above the channels. For a thick shell, this deformation has the effect that the internal diameter of the shell on its edges becomes less than its diameter when cold, the generatrix of the internal surface of the shell thus deformed intersecting with the line of this cold generatrix at a point A.

It can thus be seen that there is a point, or a small region, where the diameter variations of the shell, resulting from the combination of the radial expansion and differential axial expansion effects, are substantially zero, with the flexion compensating for the diameter increase, and where the cross-section consequently also remains virtually circular. It is more particularly in this region that, according to the invention, a frustoconical surface, bearing on the corresponding frustoconical parts of the flanges, is formed in the bore in the shell.

The distance between these regions of substantially constant diameter, which are formed on each side of the shell (in the axial direction) may, however, vary slightly between the cold and hot states of the shell, because of the overall expansion of the shell in the axial direction. This is why the flanges are preferably mounted so that they can slide on the hub, and the roll includes elastic means for moving the two flanges towards each other.

In a preferred arrangement, intended to ensure axial positioning of the shell on the hub while allowing the flanges the possibility of slight axial displacement, the roll includes means for axial abutment of the shell on the hub, which means are located in a plane which is substantially axially central to the roll, and pressure means for exerting an axial force on the said abutment means, while allowing the shell the possibility of expanding radially, without altering its axial positioning defined by the said abutment.

In a preferred arrangement, the internal surface of the shell includes at least one cylindrical bore, adjacent to and coaxial with each frustoconical surface, each flange includes a cylindrical part placed in this bore, and shell coolant feed channels are formed in the flange and in the shell, level with the said cylindrical part.

The said cylindrical bore may be formed between the frustoconical surface and the edge of the shell. In this case, a radial clearance is provided, when cold, between the cylindrical bore and the corresponding cylindrical part of the flanges, in order to allow the diameter of the edges of the shell to decrease, when hot, as explained above. Deformable joints make a seal between the channels in the flanges and the channels in the shell.

According to another arrangement, the said bore may also be formed towards the centre of the roll, that is to say on the opposite side of the frustoconical surface than in the previous arrangement.

According to yet another arrangement, cylindrical bores and corresponding cylindrical parts of the flanges of this type may be formed on either side of the conical bearing region, with the radial clearance, on the outside of the conical part, being retained. This clearance makes it possible, on the one hand, not to add shell hoop stresses and, on the other hand, allows modification of the convexity, i.e. the thermal crown, by acting on the cooling or the conditions of heat-exchange between the casting steel and the shells.

Regardless of the embodiment chosen from the three arrangements above, an advantage resulting from the location of the said channels level with the cylindrical bores and the cylindrical parts of the flanges is that sealing between flanges and shell can be achieved more easily and more reliably than if these channels were, as provided in the already mentioned document FR-A2,711,561, level with a conical bearing surface.

Other characteristics and advantages will emerge from the following description of a roll of a plant for continuous casting of thin steel products between two rolls of this type.

Figure 2:
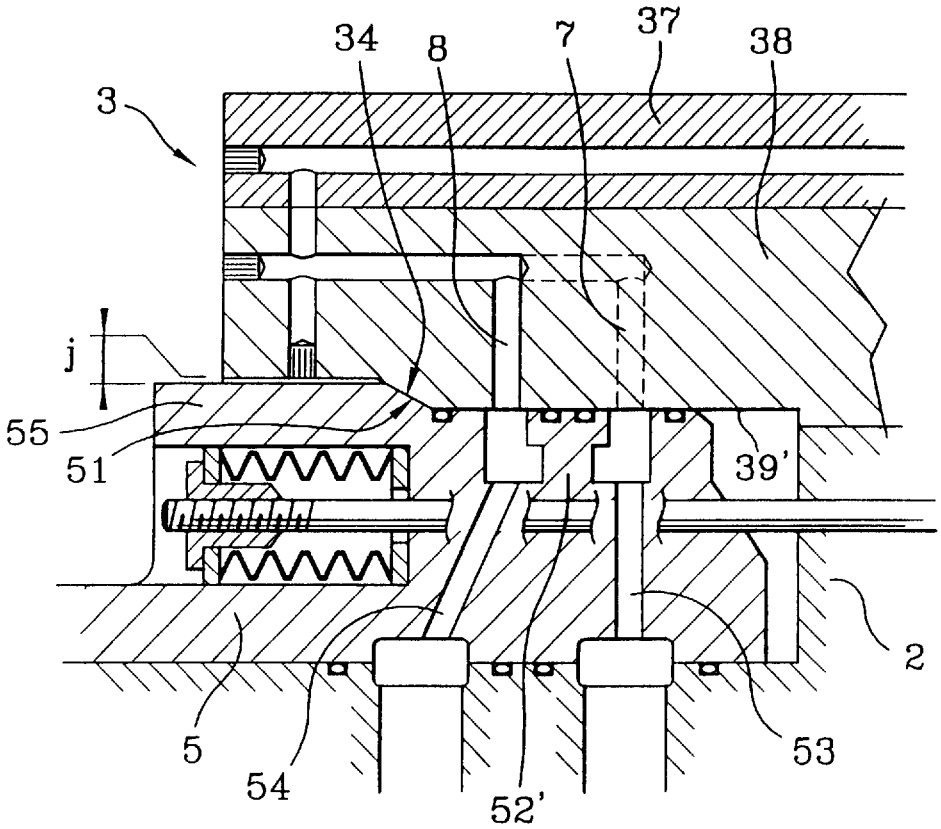
Figure 3:
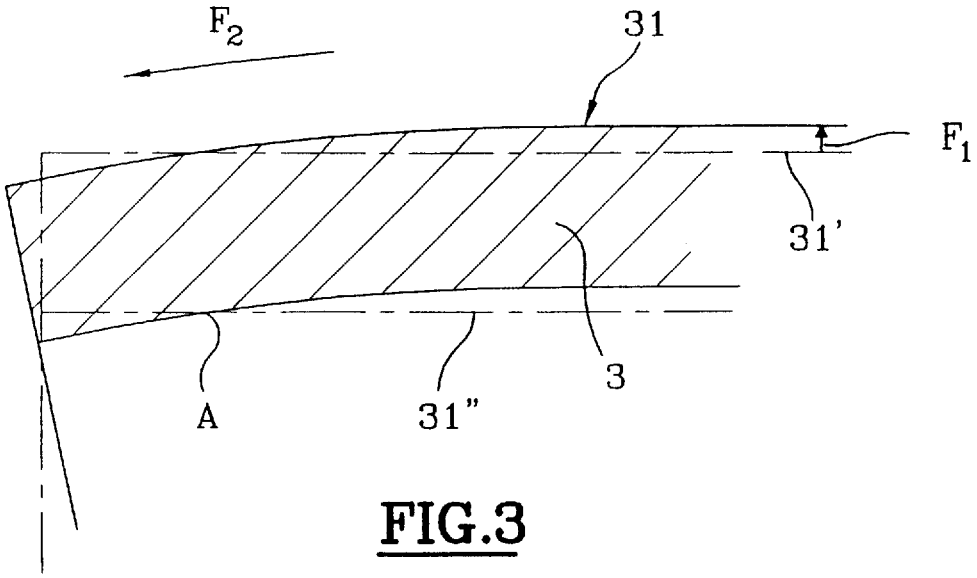

Reference will be made to the appended drawings, in which:

FIG. 1 is a view in radial half-section of a roll according to the invention, FIG. 2 is a view of an edge of a roll in an alternative embodiment, FIG. 3 schematically represents the expansion deformations of the shell, as already explained above.

The casting roll represented in FIG. 1 includes

- a shaft 1 connected to a rotational drive mechanism (not shown),
- a hub 2 linked rigidly to the shaft 1, for example by hooping and/or keying, and machined after it is mounted on the shaft, coaxially therewith,
- a shell 3 which is coaxial with the hub 2 and which constitutes a removable and interchangeable element of the roll,
- means for axially linking the shell onto the hub, including axial abutment means 4,
- two flanges 5, 6 which support and center the shell 3 on the hub 2.

The rotational linkage of the shell onto the hub is ensured, as will be seen below, on the one hand by the flanges 5, 6 and their assembly means and, on the other hand, by the axial abutment means 4 and means for exerting pressure on this abutment.

The shell 3 consists of two coaxial layers 37, 38 of different materials, the outer layer 37 being made of a material with high thermal conductivity, for example copper or a copper alloy, and the inner layer 38 being made of a material with greater mechanical strength, for example SUS 304 stainless steel. In proximity to its external surface 31, it includes cooling channels 32 which are connected at their ends to cooling-water feed and return channels 7, 8.

The hub 2 includes a central part 21 whose diameter is greater than that of its axial end parts 22, 23. The central part 21 of the hub 2 includes a shoulder 24, located in a substantially central plane P of the roll, orthogonal to its axis.

In its interior, the shell 3 includes a corresponding shoulder 33 which is therefore also located in the plane P.

Centering of the shell 3 on the hub 2, in the direction of the axis, is ensured by the shoulder 33 of the shell bearing on the shoulder 24 of the hub, which accurately defines the positioning of the shell relative to the hub and therefore relative to the entire casting plant. The positional symmetry of the shell with respect to the central plane of the roll is therefore ensured and retained even when the shell expands axially during casting, since the axial displacements of the edges of the shell, which are caused by this expansion, take place symmetrically with respect to the said central plane.

It will be noted that, because of the said radial expansion of the shell during casting, its internal diameter in its central part increases, as explained with reference to FIG. 3, and the radial centring of the shell cannot therefore be ensured by the central part 21 of the hub which remains cold, whose diameter varies virtually not at all, and which, when assembled and in a cold state, has a diametral clearance with respect to the shell.

This radial centering is ensured by the two flanges 5, 6 which are centered on the end parts 22, 23 of the hub and can slide slightly on them, substantially without play. Each flange includes a frustoconical part 51, 61 which cooperates with the surface of a bore 34, 35, also a frustoconical shape with the same conicity, formed inside the shell 3 in a region where, as explained above, the internal diameter variations of the shell, which are due to its expansion deformations, are substantially zero.

The flanges 5, 6 are pulled towards each other by elastic means for moving them towards each other, which act along the axial direction of the roll to press the frustoconical parts 51, 61 of the flanges against the frustoconical bores 34, 35 in the shell, so as to center it and support it. It should be noted that the radial centering of the shell on the hub is ensured only by the conical shell/flange bearing regions, which makes it possible to retain this centering even when the central part of the shell, when hot, moves away from the hub, under the effect of the thermal expansion convexity, as indicated above.

The elastic means for moving the flanges towards each other may consist of means for pulling the flanges towards the central part 21 of the hub, which act independently on each flange.

Preferably, as represented in FIG. 1, these means for moving the flanges towards each other comprise means for elastically linking the flanges together, which consist of a system of circonferentially distributed rods 71 which join the flanges while passing freely through bores drilled in the central part 21 of the hub. These rods 71 pass through corresponding orifices in the flanges 5, 6 and have adjusting nuts 73 on their ends.

The elastic elements, for example elastic washers 74, are placed between the nut 73 and the flange 6, so as to exert a tensile force on the flanges towards each other, while allowing them to move apart. The tensile force is adjusted, using the nuts 73, in such a way as to apply the flanges against the conical bores in the shell with a force which is sufficient to withstand the separating force which the rolls undergo during casting, without running the risk of this force, because of the conicity of the bearing regions, causing the flanges to be separated and the shell to move towards the axis of the roll. The tensile force is also adjusted so as to prevent rotational sliding, while allowing slight sliding along the axial direction as, when hot, the distance between the conical bores varies owing to the axial and radial expansion of the shell.

The centering of the flanges 5, 6 on the axial end parts 22, 23 of the hub 2 is ensured by a sliding resin injected into regions 26 formed for this purpose between the flanges and the hub, or by other means such as rolling bearings or an oil joint making it possible to minimize the clearance between the hub and the flange, for example of the order of 0.05 mm on the diameter, while keeping a high quality of axial sliding of the flanges on the hub, to avoid sticking and consecutive disturbances in the movements of the flanges.

In order to transmit the rotational drive torque between the hub and the flanges, use may be made of a known type of rotational linkage system (not shown), for example keys or other rotational linkage means which ensure continuous transmission of the torque while allowing freedom of translation in the axial direction. The transmission of the drive torque from the hub to the shell is thus ensured by this linkage system between the hub and the flanges, and by friction between the flanges and the shell.

The transmission of the torque by the means indicated above is preferably supplemented by frictional driving between the shoulder of the hub 24 and the shoulder of the shell 33.

To this end, the roll includes pressure means for pressing the shoulder 33 of the shell onto the shoulder 24 of the hub. These means include an elastic plate 80 which is fixed on the hub 2 and pressing on the shell via one or more spacers 81. This spacer may be a continuous ring placed between the shell 3 and the central part 21 of the hub 2, or alternatively may be segmented and thus formed by a plurality of independent thrust pieces in the form of tiles placed in longitudinal grooves formed at the interface between shell and hub, as indicated in document FR-A-2,711,561 mentioned above.

This ring or these thrust pieces are pressed against a second shell shoulder 36 formed in proximity to and opposite the shoulder 33. These arrangements make it possible to give the shell a generally continuous shape with uniform cross-section over its entire width, which makes it possible to minimize its thermal deformations by making them symmetrical with respect to the central plane P.

The conicity angle of the conical bearing regions is large enough to avoid any risk of the flanges jamming in the shell. Furthermore, the length of the conical surfaces in contact is small, so that the difference in internal diameter of the shell on either side of each frustoconical surface 34, 35 is also small, and therefore the thickness of the shell varies only very slightly over its entire width. The length of the conical surfaces in contact is, however, sufficient to provide a contact region which is sufficient to withstand the roll separation forces generated by the metal which is cast.

The location of the frustoconical surfaces 34, 35 in the axial direction is determined experimentally and/or by a computation model which, in a manner known per se, makes it possible to determine the deformation of the shell when hot as a function of its geometry, of the nature of the material or materials which form it, and of parameters such as the water flow rate in the cooling channels, the heat-exchange coefficients, etc. It is then possible to determine the point or the region of the profile of the internal surface of the shell where the radial expansions compensate for the flexural deformations.

By way of example, for an overall water flow rate in the shell channels as a whole of 400 $m^3/h$, the shell having a width of 1300 mm, and with a mean extracted heat flux of 8 $MW/m^2$, this point is calculated at 560 mm from the central plane of the roll.

The position of the conical bearing regions which is thus determined may be corrected in order to take account of the other forces exerting on the shell and its support and centring means, and will then result from a compromise between the following objectives:

minimizing the movements of the flanges relative to the shell, which is achieved by locating these bearing regions as close as possible to the region where the convexity deformation (flexion of the radial section) of the shell compensates for its radial expansion, minimizing the deformation of the shell under the effect of the axial forces exerted on it by the flanges, stability of the position of the flanges under the forces exerted on the shell, during casting, by the product which is cast, said forces being retransmitted to the flanges via the said conical bearing regions, this stability being achieved by adjusting the conicity angle so that the resultant of the actions of the shell on the flanges passes between the bearing regions 26 for each flange on the hub 2.

In the example represented in FIG. 1, each flange 5, 6 includes, on the larger-diameter side of the frustoconical part 51, 61, a cylindrical part 52, 62 which is located in a cylindrical bore 39, 40 formed in the shell between the frustoconical surface 34, 35 and the edges of the said shell. A radial clearance, of the order of 0.6 to 0.8 mm when cold, is formed between the said cylindrical parts of the flanges and the corresponding bores of the shell, in order to allow the above-explained reduction in the diameter of the edges of the shell when hot.

The cooling-water feed and return channels 7, 8 open at the internal surface of the shell into the said cylindrical bore, where they communicate with respective shells 53, 54 which are formed in the flanges and themselves communicate with main channels 27, 28 formed in the hub. Joints 55 seal these channels at the interface between the cylindrical part of the flange and the corresponding cylindrical bore in the shell.

In the alternative embodiment represented in FIG. 2, the cylindrical part 52' of the flange 5 and the corresponding cylindrical bore 39' in the shell, where the channels 7, 8, 53, 54 pass, are located on the other side of the frustoconical bearing region, that is to say on its smaller-diameter side. In the region located between the conical bearing region and the edge of the shell, the latter also includes a cylindrical bore which accommodates a second cylindrical part 55 of the flange, with a minimum clearance allowing the above-explained deformation of the shell, although this clearance may be greater in this embodiment.

Regardless of the embodiment, the communication of the respective channels of the shell and of the flange at a cylindrical interface facilitates the corresponding machinings and makes it possible to ensure a better seal at this interface.

The flanges 5, 6 are preferably made of a material which has a coefficient of expansion equal to or close to that of the material of the hub, which guarantees centering of the flanges on the hub even when these pieces are subjected to temperature variations which, even if they remain small, are inevitable in practice.

On another hand, the frustoconical part of the flange will be made, or will include a cover layer, of a material with low coefficient of friction, in order to facilitate its sliding against the frustoconical surface of the shell, upon relative micro-displacements which may take place between these surfaces.

What is claimed is:

1. Casting roll for a plant for continuous casting of metals onto one or between two such rolls, this roll including a hub (2) and a shell (3) which are arranged coaxially, and two flanges (5, 6) for supporting and radially centering the shell on the hub, characterized in that each flange includes a frustoconical part (51, 61) which cooperates with a corresponding frustoconical surface (34, 35) of the bore in the shell, the said frustoconical surface being located in a region (A) where the internal diameter variations of the shell, due to the thermal expansion deformations, are substantially zero.

2. Roll according to claim 1, characterized in that the roll includes elastic means (71, 74) for moving the two flanges towards each other.

3. Roll according to claim 1, characterized in that it includes means (24, 33) for axial abutment of the shell on the hub, which means are located in a plane which is substantially axially central to the roll, and pressure means (80, 81) for exerting an axial force on the said abutment means.

4. Roll according to claim 1, characterized in that the internal surface of the shell includes at least one cylindrical bore (39, 40, 39'), adjacent to and coaxial with each frustoconical surface (34, 35), each flange (5, 6) includes a cylindrical part (52, 62, 62') placed in this bore, and shell coolant feed channels (7, 8; 53, 54) are formed in the flange and in the shell, level with the said cylindrical part.

5. Roll according to claim 4, characterized in that the said cylindrical bore (39, 40) is formed between the frustoconical surface (34, 35) and the edge of the shell.

6. Roll according to claim 4, characterized in that the said cylindrical bore (39') is formed towards the center of the roll with respect to the frustoconical surface (34).

7. Roll according to claim 4, characterized in that cylindrical bores and corresponding cylindrical parts of the flanges are formed on either side of each conical part.

8. Roll according to claim 1, characterized in that the shell (3) includes two coaxial layers (37, 38) of different materials.

9. Roll according to claim 8, characterized in that cooling channels (32) are formed in an outer layer (37) of the shell.

10. Roll according to claim 1, characterized in that each flange (5, 6) is made essentially of a material having a coefficient of expansion substantially equal to that of the material of the hub (2).

11. Roll according to claim 1, characterized in that the frustoconical part (51, 61) of each flange consists, at least at the surface, of a material which promotes sliding.

* * * * *